US005944443A

United States Patent [19]

Benedict

[11] Patent Number: 5,944,443

[45] Date of Patent: Aug. 31, 1999

[54] ADJUSTABLE POROUS GROYNES AND METHOD FOR SHORELINE RECLAMATION

[75] Inventor: Charles E. Benedict, Tallahassee, Fla.

[73] Assignee: Beach Reclamation, Inc., Tallahassee, Fla.

[21] Appl. No.: 09/027,549

[22] Filed: Feb. 23, 1998

Related U.S. Application Data

[63] Continuation-in-part of application No. 08/582,253, Jan. 3, 1996, Pat. No. 5,720,573.

[51] Int. Cl.[6] ..... E02B 3/04

[52] U.S. Cl. ..... 405/21; 256/12.5; 405/15; 405/32; 405/34

[58] Field of Search ..... 405/15–17, 21–35; 256/12.5

[56] References Cited

U.S. PATENT DOCUMENTS

| | | | |
|---|---|---|---|
| 20,105 | 4/1858 | Tracy . | |
| 227,483 | 5/1880 | Case . | |
| 388,338 | 8/1888 | Bright . | |
| 449,184 | 3/1891 | Solomon . | |
| 1,060,357 | 4/1913 | Nies . | |
| 1,165,906 | 12/1915 | Rhoades | 256/12.5 |
| 1,572,732 | 2/1926 | McCammack | 256/40 |
| 1,635,730 | 7/1927 | Tromanhauser | 405/15 X |
| 1,646,168 | 5/1927 | Pringle . | |
| 1,716,509 | 8/1929 | Smith . | |
| 1,721,894 | 7/1929 | Abbe . | |
| 1,844,484 | 2/1932 | Smith . | |
| 1,906,442 | 5/1933 | Barrus . | |
| 1,948,639 | 7/1934 | Youngberg . | |
| 1,969,123 | 8/1934 | Doble . | |
| 2,097,342 | 10/1937 | Rehfeld . | |
| 2,135,337 | 2/1938 | Herbest, Jr. . | |
| 2,341,515 | 2/1944 | Rehfeld | 405/32 |
| 2,662,378 | 12/1953 | Schmitt et al. . | |
| 2,961,255 | 11/1960 | Trott . | |
| 3,426,536 | 2/1969 | Danz . | |
| 3,564,853 | 2/1971 | Csiszar . | |
| 4,118,937 | 10/1978 | Mansen . | |
| 4,688,024 | 8/1987 | Gadde | 405/63 X |
| 4,710,056 | 12/1987 | Parker . | |
| 4,738,563 | 4/1988 | Clark . | |
| 4,861,193 | 8/1989 | Newkirk . | |
| 5,108,222 | 4/1992 | Jansson et al. | 405/15 |
| 5,255,997 | 10/1993 | Bailey et al. . | |
| 5,348,419 | 9/1994 | Bailey et al. . | |

FOREIGN PATENT DOCUMENTS

| | | | |
|---|---|---|---|
| 1300074 | 3/1987 | U.S.S.R. | 256/12.5 |

*Primary Examiner*—Dennis L. Taylor
*Attorney, Agent, or Firm*—Dowell & Dowell, P.C.

[57] ABSTRACT

A method and apparatus for shoreline reclamation which includes utilizing groyne structures including stanchions to which are mounted at least one porous screen and wherein the screen is vertically adjustable as material is deposited during the reclamation process.

12 Claims, 4 Drawing Sheets

ADJUSTABLE POROUS GROYNES AND METHOD FOR SHORELINE RECLAMATION

CROSS REFERENCES TO RELATED APPLICATIONS

This application is a continuation-in-part of U.S. application Ser. No. 08/582,253 filed Jan. 3, 1996 now U.S. Pat. No. 5,720,573, and entitled ADJUSTABLE POROUS GROYNES AND METHOD FOR SHORELINE RECLAMATION and assigned to the Assignee of the present application.

STATEMENT AS TO RIGHTS TO INVENTIONS MADE UNDER FEDERALLY SPONSORED RESEARCH AND DEVELOPMENT

None

BACKGROUND OF THE INVENTION

The present invention is directed to porous groyne structures and method for their use in reclaiming beach and shoreline areas which are subject to erosion by natural forces and, more specifically, to porous groyne structures which are vertically adjustable during use, thereby allowing the porous material of the groynes to be systematically raised as reclamation progresses from the buildup of silt, sand, shells, grasses and other materials.

Beach and other shoreline erosion, especially in coastal areas, is a major concern to property owners who have residences or establishments which are situated in close proximity to the shoreline. Not only is there a tremendous personal and economic loss caused by damage to, or loss of, real estate, housing and commercial buildings by shoreline or beach erosion, but there is also recreational loss of waterfront property which adversely affects the general public.

To deter coastal erosion in many areas, large seawalls are constructed to prevent high tides from reaching land and property. Such structures are costly and are only practical when population densities make it economically reasonable to construct them. Further, such structures have an adverse effect on the natural appearance of the shoreline and, in many areas, cannot be practically constructed.

Other methods of shoreline reclamation include creating jetties or artificial barriers or reefs which extend from the shoreline. These structures are permanent installations and are generally utilized to prevent sand along coastal areas from washing out to sea by wave action. Like seawalls, however, such structures are costly to construct and maintain and, in some areas, are not appropriate for use due to the shoreline configuration, prevailing currents or tidal activity and the like. Also, such structures create a safety hazard in areas where recreational activity is anticipated.

A further method for reclaiming shoreline areas and preventing further erosion is the placement of off-shore, underwater barriers. Often, large porous structures are placed along a sea floor or riverbed at some distance from the existing shoreline. The structures are provided to break wave, current or tidal action thereby creating a zone of low velocity water flow adjacent a beach or riverbank so that sand, silt and other particulate material will settle out of the water before being conveyed by fluid currents out from the shoreline. Again, such outer barriers are only appropriately used in some locations and are not appropriate for use in many locations and may be objectionable for use in some areas due to the adverse affect on aquatic life.

Other methods which are widely used to reclaim shorelines or beaches are dredging and sand importation. When major dunes along a shoreline are damaged or washed away during heavy storms, it is often necessary to import new dirt and sand to re-establish the dunes to provide a natural barrier to tidal activity. Dredgers are commonly utilized to pump sand from a sea floor or riverbed to build up natural barriers. Such methods of shoreline reclamation, however, are temporary measures at best and do not provide a long-term solution to shoreline erosion. Further, such restoration methods are extremely costly and are not practical in many locations.

In view of the foregoing, there is a need to provide a method and apparatus for economically reclaiming damaged shorelines and beach areas which can be practically used in almost any area without an adverse effect to either land or sea environments. In U.S. Pat. Nos. 1,969,123 and 4,710,056, methods and structures for beach restoration are disclosed which utilize netting for purposes of trapping sand, shells and other particulate matter carried by wave action. Nets are extended outwardly from the shoreline and are left in place until a buildup of sand and other particulate matter is established after which the nets, which may be buried several feet or more in the newly collected material, are withdrawn by winches or other means. The removal of the netting material can adversely affect the restored shoreline by creating trenches or furrows which form natural channels in which water flows away from the shoreline thereby conveying particulate matter back to a body of water.

Other examples of porous shoreline reclamation structures are disclosed in U.S. Pat. Nos. 227,483 to Case, 1,060,357 to Nies, 1,948,639 to Youngberg, 1,646,168 to Pringle, 2,097,342 and 2,341,515 to Reheld, 2,135,337 to Herbert, Jr., 2,662,378 to Schmitt, et al., 3,564,853 to Csiszar, 4,861,193 to Newkirk, 4,118,937 to Mansen, 4,738,563 to Clark, 5,108,222 to Jansson, et al., and 5,255,997 to Bailey, et al.

SUMMARY OF THE INVENTION

The present invention is directed to a method and apparatus for reclaiming shoreline and offshore areas which includes the installation of removable groynes having a plurality of posts or stanchions which are embedded along the shoreline and/or in the sea floor in spaced relationship with one another and between which are mounted one or a plurality of porous screens. As used herein, the term shoreline refers to both land and offshore bottom areas including beaches and banks situated along lakes, rivers, inlets, bays, seas, oceans and the like, it being the express purpose of the present invention to build up solid material deposits both on and offshore. The screens may be formed of any suitable materials having a plurality of openings therein and, in preferred embodiments, are formed of flexible elements such as chain link, conventional netting, geo-textiles, expanded plastics, nylon meshes, knitted and woven fabrics and the like. In some embodiments, the openings may be created in somewhat non-flexible materials such as open slatted wooden or plastic structures.

The screens are supported relative to the stanchions and extend to lower edges which are designed to rest on and become temporarily embedded in the material forming the shoreline. The groynes further include means for periodically and systematically elevating the lower portion of the screens to thereby prevent the screens from being too deeply embedded within newly deposited particulate material. Such means may include tie lines and/or take-up reels which are used to elevate the screens by either manual or motor operated hoisting or winch-like devices. The hoist or winch devices may be mounted at a common point for each groyne or may be separately attached to spaced stanchions along a groyne.

The screens of the present invention are particularly designed so as to be non-uniform in mesh openings between the lower portions and upper portions thereof. In preferred embodiments, a plurality of screen sections are vertically joined with respect to one another with the lower screen sections having mesh openings of a smaller dimension than each subsequent vertical section. Typical openings may range from approximately ⅛" in the lowermost screen section to 1" or more in uppermost screen sections. In one embodiment, four screen sections are disclosed, although the number of screen sections may be varied depending upon the requirements of a particular reclamation site.

The screen sections are elevated utilizing lifting ropes or lines which are secured at least along the lower edge of the screen and preferably at spaced elevated locations along the screen, such as at the intersection of the various vertical sections of the screen.

Utilizing the methodology of the present invention, a plurality of spaced groynes are positioned so as to extend outwardly from the shoreline in spaced relationship with respect to one another. The orientation between the groynes and their angular relationship with respect to the shoreline will be dictated by the specifics of a given area and the currents, tidal activity and winds in the area. Once the screen or screens have been secured to the spaced stanchions, the lower portions of the screens are periodically elevated as deposits form at the base of the screen so as to not become too deeply embedded in the newly deposited material.

Preferably, the lower portion or lower edge of the screens are elevated such that a portion of the lower edge or screens is retained within the material deposit, so that the material deposit acts as an anchor to secure the lower edge of the screen to the sea floor or the bed of the body of water. The structure of the present invention further facilitates the raising of the entire screen and securing of the screen in a raised position during periods when it is necessary not to interfere with movement of aquatic life relative to the groyne structure. Following reclamation, the structure of the present invention may be easily removed without disturbing the contour of the reclaimed shoreline.

It is a primary object of the present invention to provide a method and apparatus for economically reclaiming land along shorelines and offshore areas of oceans, gulfs, inlets, bays, rivers, lakes as well as other areas where currents and tidal and/or wind activity is experienced.

It is a further object of the present invention to provide groyne structures and a method for installing groyne structures along shorelines in such a manner that the groynes may be temporarily installed and removed after land has been reclaimed without disturbing the natural contour of the reclaimed land.

It is yet a further object of the present invention to provide groyne structures which may be utilized to reclaim land along a shoreline which are environmentally compatible and which may be continuously adjusted so as to not adversely affect the buildup of deposited materials.

It is also an object of the present invention to provide groyne structures which may be utilized to reclaim land along a shoreline which include screen materials having sections of different porosity or opening sizes such that the smaller openings in the screen are provided along the lower sections thereof to facilitate buildup of fine particles along the base of the screen.

It is another object of the present invention to provide a method and apparatus for economically reclaiming land along shorelines and offshore areas of oceans, gulfs, inlets, bays, rivers and the like wherein the buildup of material deposits is utilized to temporarily anchor the lower portion of the screen(s) associated with the groyne structure and wherein the screen structures are periodically elevated so as to prevent the adverse disturbance of accumulated deposits.

BRIEF DESCRIPTION OF THE DRAWINGS

The present invention will be best understood with reference to the accompanying drawing figures, wherein.

DESCRIPTION OF THE PREFERRED EMBODIMENTS

Figure 1:
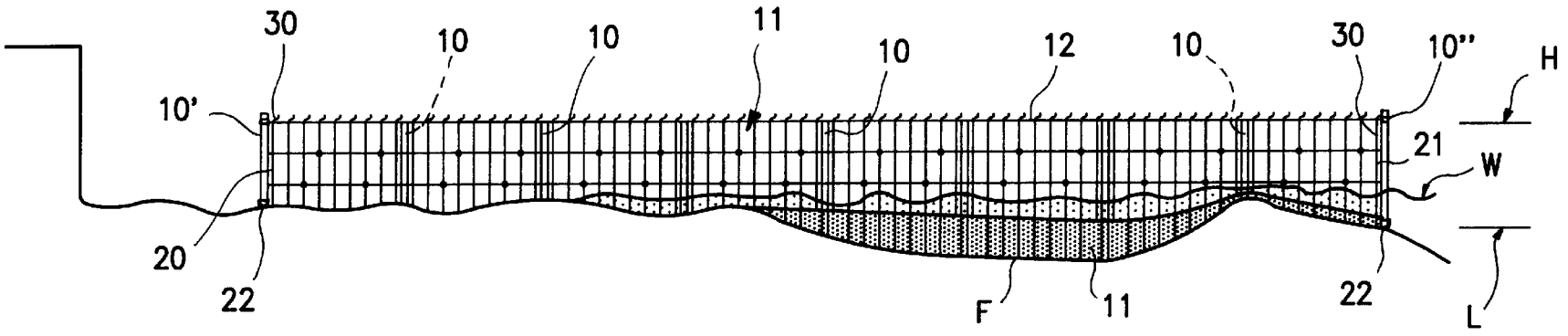
FIG. 1 is a side elevational illustrational view of the invention showing the deployment of the stanchions and screen relative to a shoreline and extending outwardly therefrom.

With continued reference to the drawing figures, the porous groyne system of the present invention will be described in greater detail. The porous groyne system is specifically configured to capture rocks, shells, sand and other particles and deposit them along the beach in order to reclaim beach frontage in such a manner that reclaimed materials are not adversely disturbed by the use of the system. With specific reference to FIG. 1, the porous groyne structures are designed to extend outwardly generally from a high tide line "H" to a low tide line "L" or beyond into the water at various angles from the beach. In some areas, the groynes may be deployed generally perpendicularly from the beach outwardly into the body of water; in other areas, it may be necessary to incline the groynes at an angle between the shore and the water. The groynes are designed to be installed so that they extend just above the maximum high tide line "H".

Figure 3:
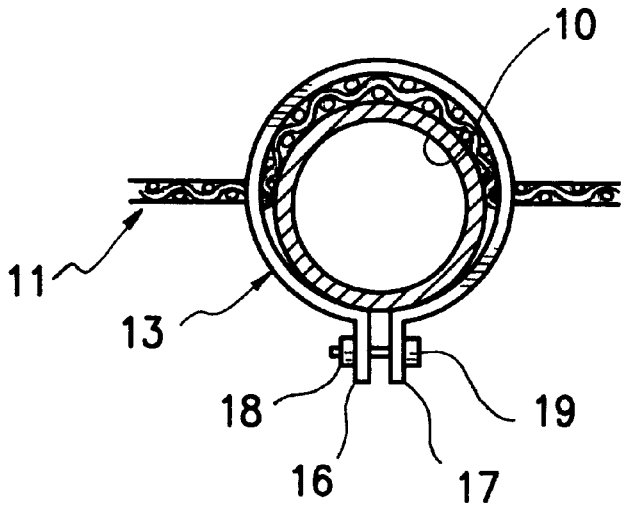
FIG. 3 is a top plan view of one of the stanchions of the present invention showing a clamp for securing the screen relative thereto in accordance with the teachings of the present invention.
Figure 5:
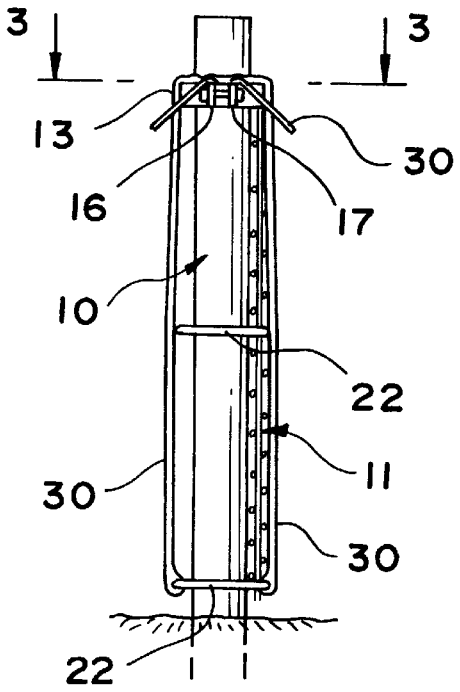
FIG. 5 is an enlarged side illustrational view showing one of the stanchions of the present invention and the clamp for securing the screen thereto and showing the screen being secured to the stanchion utilizing one or more guide rings.

The groynes include a plurality of spaced posts or stanchions 10 which may be formed of any sufficiently durable and environmentally compatible supporting material. In some embodiments, galvanized pipe will be utilized because of cost, strength and durability. The posts are embedded into the beach and the sea floor a sufficient distance to support screening material 11 which, in the preferred embodiment, is designed to extend from the innermost post 10' toward the outermost post 10". The posts will be spaced at approximately 20 feet intervals, however, the spacing may vary. Further, although the screen material 11 is shown as being a continuous screen element in FIG. 1, it is possible that two or more screens may be utilized in a single groyne structure or that a single screen or mesh may be placed between each pair of stanchions. Further, as shown in FIGS. 3 and 5, a clamp 13 may be clamped adjacent the top of two or more stanchions for purposes of securing the screen or mesh material to each post. Lifting lines are placed at each post and at intermediate positions between the posts as required for lifting the bottom and intermediate portions of the screen or mesh upward as required as the reclamation process proceeds, as will be described hereinbelow.

The porous screen or mesh 11 may be formed of substantially any suitable materials having a plurality of openings therein. It is preferred that the openings be varied or non-uniform throughout the structure of the screen material and that the openings near the lower edge 14 of the screen be smaller than openings at the intermediate and upper portions of the screen. In this respect, openings as small as ⅛" are contemplated adjacent the lower edge 14 of the screen, with openings varying to as much as one or more inches at the upper portion. The lower edge of the screen may be formed with a conventional selvage material if the screen is formed of fabric. The screen is preferably constructed of pliable or flexible materials including chain link, conventional netting, geo-textiles, expanded plastics, nylon meshes, knitted or woven fabrics and the like. The screen also includes an upper edge 12 which may be formed as a selvage material which, in some embodiments, may include an inner supporting cord or rope (not shown).

Figure 4:
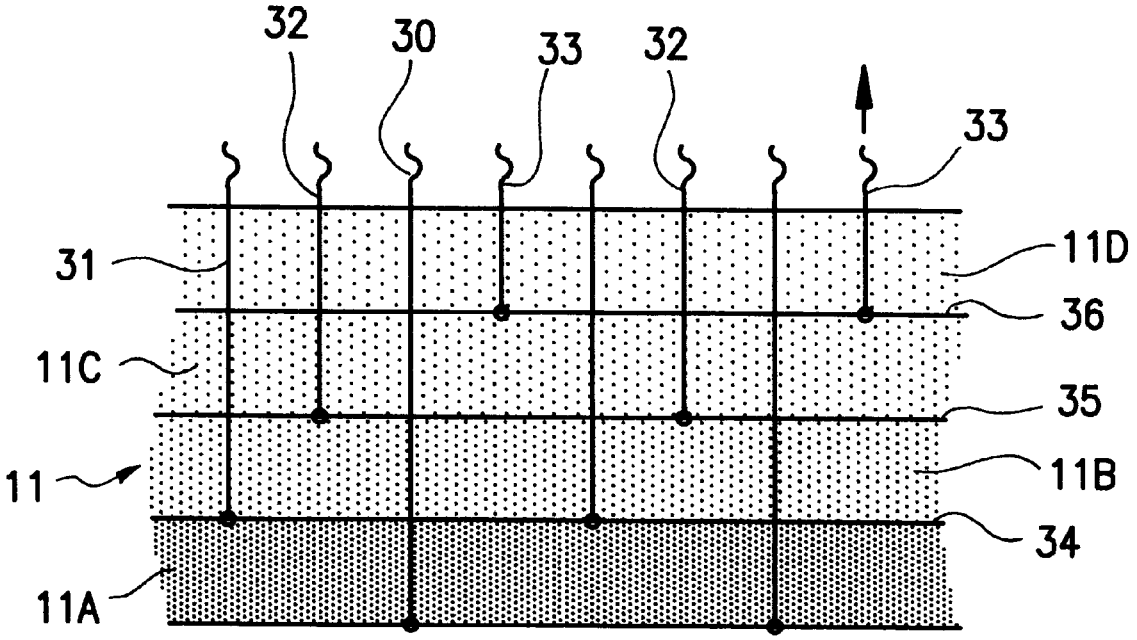
FIG. 4 is a partial front plan view of one embodiment of the sectioned screen utilized with the porous groynes of the present invention.

With particular reference to FIG. 4, the details of a preferred screen, net or mesh structure in accordance with the invention are shown in detail. The screen 11 includes a plurality of separate vertically spaced sections 11A, 11B, 11C and 11D extended upwardly from the bottom edge 14 to the upper edge 12. Section 11A is constructed of a fine mesh material defining openings of approximately ⅛" therethrough while the mesh of section 11B defines openings of a larger size such as ¼" therethrough. Section 11C is formed of a more open mesh having larger openings in the order of ½" and the least dense upper screen section 11D has the largest openings of ¾" or greater therethrough. The screen sections are preferably horizontally connected using sturdy longitudinal cords 34–36. Separate cords or ties may be used to reinforce upper and lower edges 12 and 14 of the screen.

The lower sections of the screen are designed to trap finer particles and to reduce the pass-through fluid velocity of tidal waters to facilitate solid deposits along the bottom of the screen. The mesh materials are also preferably formed of a material exhibiting at least a 200 lb. Test.

As previously noted, the upper portion of the screen material is securely attached to at least two stanchions by clamps 13, as shown in FIGS. 3 and 5, such as a C-ring clamp conventionally used with chain link fence structures to secure the chain link to support posts. The clamps are mounted about the posts or stanchions and through the mesh material adjacent the upper edge 12 of the screen and are secured by connecting the outer spaced flanges 16 and 17 thereof by nut and bolt fasteners 18 and 19. In some embodiments, it may be possible to secure the screening material only to the innermost post 10' and outermost post 10" utilizing the clamps 13.

As shown in FIG. 5, in some embodiments, the innermost edge portion 20 and outermost edge portion 21 of the screen or mesh material are secured to the innermost post 10' and outermost post 10" utilizing moveable rings 22 of a size to slidably engage the posts. The edges 20 and 21 may be secured to the rings by sewing or by the use of small clips. In the drawing figures, at least a lower ring and an intermediate ring are provided for each of the support posts 10' and 10". Additional ring members may be utilized depending upon the height of the posts and the height of the screen material.

Although in some embodiments, it may also be desired to utilize ring members 22 on the intermediate posts 10, in the preferred embodiment, it is not believed that such rings will be necessary. The screen or netting material 11, however, is preferably weaved between the support posts 10. Therefore, as shown in FIGS. 1 and 3, the screening material passes behind the first post 10 spaced from the innermost post 10' and then extends forwardly of the second post out from the innermost post 10' so that the screen or netting material passes in front and then behind adjacent stanchions or posts. This type of mounting arrangement will firmly secure the screen or mesh material without requiring the use of additional fastening elements so that the material will not be displaced by tidal or wave action. However, in some embodiments, the screen or screens may be secured to the stanchions without being weaved therebetween.

Figure 6C:
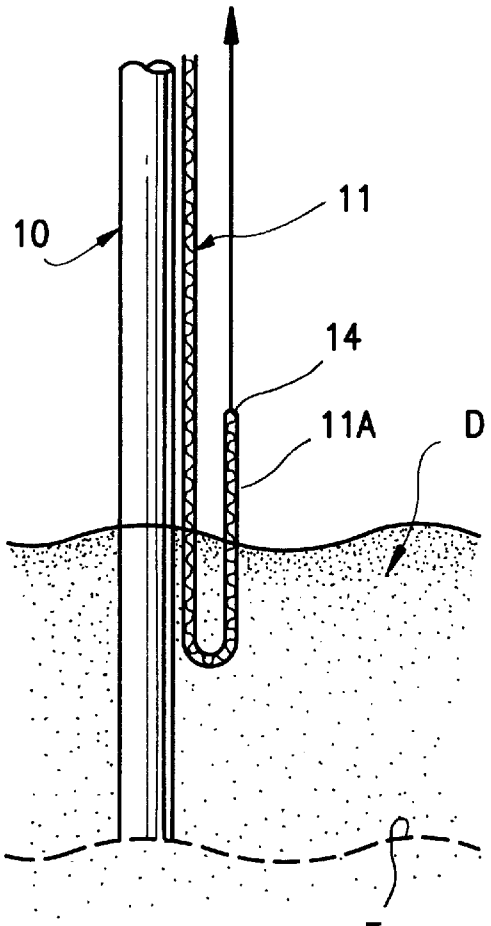
FIGS. 6A–6C show a first structure for periodically elevating the lower portion of the screen of the present invention as materials are deposited and illustrating the manner in which the lower portion of the screen is retained anchored by the newly deposited material in FIG. 6C.
Figure 6B:
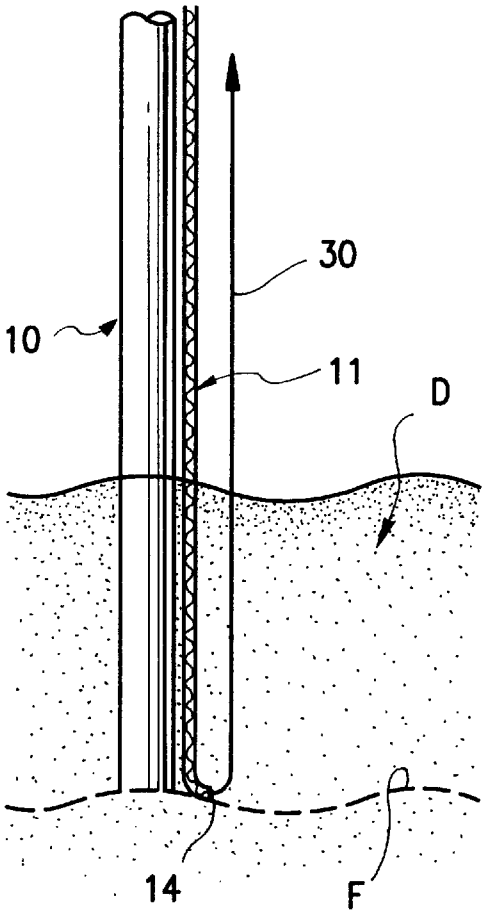
Figure 6A:
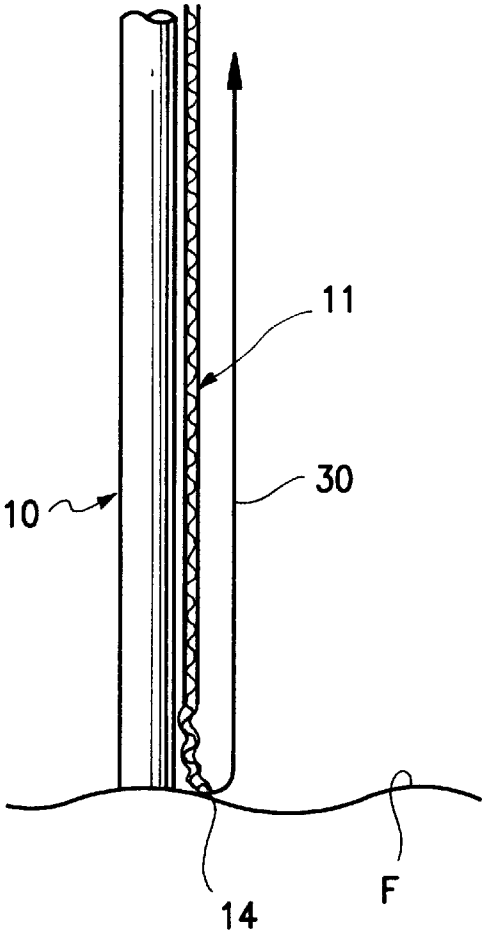

The lower portion of the screen 11 is designed to rest along the beach and the floor "F" of the body of water "W", as shown in FIG. 1, when initially deployed. The netting material will be pulled taut before finally being secured to the stanchions during deployment. As sand, gravel, shells, rocks and other solid materials become trapped along the lower portion, the lower edge 14 thereof will be periodically raised. It is preferred to periodically elevate the lower portion 14 of the screening material so as to limit disturbance of newly deposited materials during the reclamation process. With specific reference to FIG. 6A the lower edge of the screen 11 is initially deployed in contact with the floor "F" of the body of water "W". After material deposits begin to build, as shown in FIG. 6B, to a height, for example, of approximately 2 to 3 feet, the lower edge 14 of the screen is raised utilizing draw or lift cords so that the lower edge is raised above the material deposit "D" with an intermediate portion 11' of the screen being buried approximately a foot within the deposit, as shown in FIG. 6C. The screen is continuously and periodically raised so as to not adversely interfere with the buildup of deposits while the deposits function as an anchor for retaining the lowest deployed portion of the screen in position as new deposits are being formed.

Figure 7:
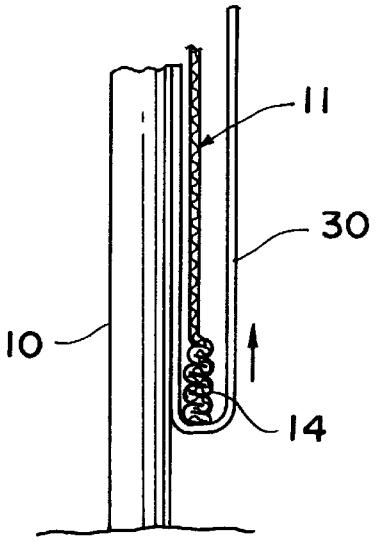
FIG. 7 discloses an alternate embodiment for elevating the lower portion of the screen of the present invention.

In this respect, it is contemplated that the screen may be raised in other ways. With respect to FIG. 7, the screen may also be raised in an accordion-type fashion by a plurality of lift ropes, cords or lines 30 which are associated with or provided adjacent each of the posts or stanchions 10. The ropes 30 extend down and around the bottom edge 12 of the screen or mesh material and back to the upper portion of the screen adjacent the posts where the lines are either tied to the posts or to the mesh material of the screen. A separate clamp may be utilized for purposes of securing the ends of the lifting ropes. In this embodiment, when it is desired to elevate the lower portion of the mesh material, the rope is elevated, thereby lifting the screen or net from the lower edge upwardly. As with the embodiment shown in FIGS. 6A–6C, it may be preferred to raise the lower edge after deposits are formed only to a height which will ensure that a portion of the screen is retained and anchored within the material deposits.

As shown in FIG. 5, in some embodiments, it is preferred that two lifting ropes, cables or lines 30 be associated with the innermost post 10' and the outermost post 10" which ropes or lines are connected to or about the lowermost ring members 22. The use of two ropes prevents the rings from binding against the posts if lifted only at one angle from a single rope. However, a single rope may also be used.

To further facilitate the elevating of the screen or mesh material during the reclamation process, intermediate lifting ropes or lines 31–33 are provided which are secured to the mesh cords 34–36 which extend between the sections of the screening material, as shown in FIG. 1. Although a single intermediate lifting rope or line may be used between each of the stanchions, the additional, supplemental or intermediate lifting lines or ropes may be used. In the use of these lines, when it is necessary, the lines are untied from the upper edge 12 of the screen or mesh material and thereafter elevated to raise the screening material as previously discussed. Thereafter, the lines are simply re-tied to the upper edge 12 of the screen or mesh material, thereby holding the lower portions of the screen in the newly deployed position.

During use, the groynes structures will be spaced at various intervals relative to one another along a given area of beachfront or shoreline. The exact spacing will be determined by the wind, wave and tidal action as well as the contour of the bottom in the area which is to be reclaimed. Once material deposits have elevated to a predetermined height, the screening material and, in some instances, the posts or stanchions, are removed to allow natural buildup of additional deposits along the beachfront.

Figure 8:
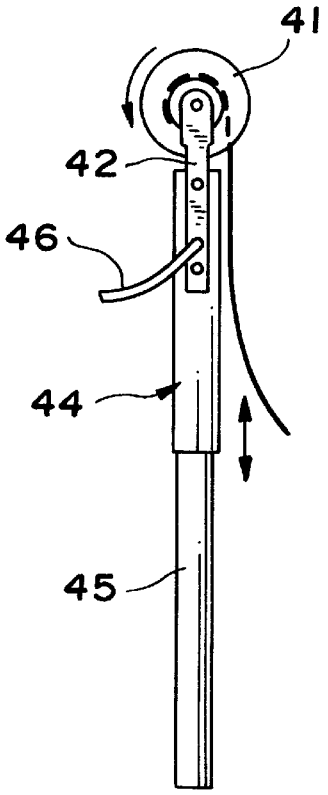
FIG. 8 is a side elevational view of a retractor device which may be utilized with the present invention to elevate the screen associated therewith.

With particular reference to FIG. 8, to facilitate raising of the screen 11, one ore more portable retractors may be used. Each retractor includes a take-up reel 41 to which one end of the lift lines 30–33 may be attached. Each reel 41 is mounted by a bracket 42 to a support member 44. In some embodiments, the support member may be formed as a hollow pipe which is of a size to be seated over the upper end of a respective stanchion or post 10. In other embodiments, the support member may be a manually engageable handle or an extendible assembly including an extension 45 which can be used to support the retractor from the sea floor. Further, although the reel may be manually operated, a pneumatic or hydraulic line 46 could be connected between a suitable fluid control source and a drive motor (not shown) for purposes of powering the take-up reel.

Figure 2:
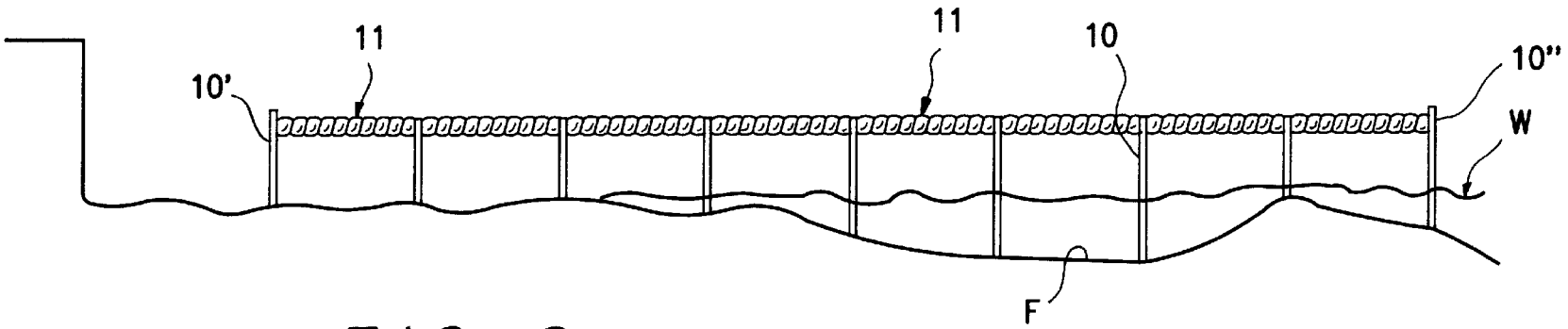
FIG. 2 is a view similar to FIG. 1 except showing the screen material being raised and tied off so as to not obstruct natural movement of aquatic life.

The present invention facilitates the reclamation of shoreline areas without adversely affecting the environment or aquatic life. As shown in FIG. 2, when necessary, such as to prevent interference with aquatic life relative to beach areas such as the movement of turtles to the shore to lay eggs, the screen(s) of the porous groyne system may be raised and secured. After the egg laying seasons is over, the screen(s) may be readily re-deployed.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A method of reclaiming land along a shoreline or offshore by causing the deposit and retention of particulate material utilizing a plurality of spaced groynes, each groyne including a plurality of spaced stanchions which support at least one screen means having upper and lower portions and side edges, and the at least one screen means being elevatable with respect to material being deposited and wherein the at least one screen means is formed having a plurality of different sized openings therethrough through which water will flow and cause the particulate material to deposit but which are of the size to prohibit passage of larger solid material carried in tidal currents comprising the steps of:

a) placing the stanchions in spaced relationship relative to one another extending from the shoreline or offshore;

b) mounting the at least one screen means to the spaced stanchions so that the lower portion thereof is engageable with the shoreline or offshore to thereby create a buildup of newly deposited solid materials adjacent the lower portion thereof;

c) preserving the buildup of newly deposited solid materials by periodically elevating at least the lower portion of the at least one screen means so that the lower portion thereof is maintained substantially at the height of newly deposited solid materials.

2. The method of claim 1 in which said lower portion of the at least one screen means is elevated by gathering the lower portion vertically upwardly toward the upper portion.

3. The method of claim 1 including guiding the edges of the at least one screen means vertically upwardly along the stanchions as the lower portion is elevated.

4. The method of claim 1 in which said lower portion of said at least one screen means is elevated by lifting the lower portion using a plurality of spaced flexible lifting elements and tying said plurality of lifting elements adjacent the upper portion of the at least one screen means.

5. The method of claim 4 including lifting said plurality of lifting elements vertically upwardly using a winding mechanism.

6. A porous groyne for shoreline and offshore reclamation comprising:

a plurality of spaced stanchions, at least one screen means supported between said stanchions, said at least one screen means having an upper portion and a lower portion and having a plurality of vertically arranged screen sections each having openings therein through which water and some suspended solids may pass, the openings of at least two screen sections being of a different size, means for supporting said at least one screen means relative to said stanchions, and elevating means for periodically elevating said lower portion of said at least one screen means relative to said stanchions.

7. The porous groyne of claim 6 in which said elevating means includes a plurality of flexible elements secured at different vertical locations to said at least one screen means and having upper ends extending relative to said upper portion thereof so as to be securable to said upper portion of said at least one screen means to retain said lower portion of said at least one screen means in an elevated position.

8. The porous groyne of claim 6 in which said means for supporting said screen means includes a plurality of clamp means for securing said upper portion of said at least one screen means to said stanchions.

9. The porous groyne of claim 8 including at least one guide element mounted to at least two of said spaced stanchions, means for securing said lower portion of said at least one screen means to said guide means whereby said lower portion of said at least one screen means is guided relative to said at least two spaced stanchions by said guide means as said at least one screen means is periodically elevated.

10. The porous groyne of claim 6 in which a lower of said vertically arranged screen sections includes openings of a first dimension therein, said first dimension being smaller than the dimension of openings in said screen sections spaced vertically upwardly relative to said lower section.

11. The porous groyne of claim 10 including at least four screen sections, each of said screen sections having openings of a different size therethrough with the openings increasing in size from the lower screen section to an upper screen section.

12. The porous groyne structure of claim 11 including strengthening elements positioned between each of said vertically arranged screen sections, and said elevating means including a plurality of flexible elements mounted to said at least one screen means having lower ends secured to said at least one screen means and upper ends extending adjacent the upper portion thereof.

* * * * *